US006490968B2

(12) United States Patent
Lutz et al.

(10) Patent No.: US 6,490,968 B2
(45) Date of Patent: Dec. 10, 2002

(54) METHOD OF FINISHING GOLF BALLS EMPLOYING DIRECT DIGITAL-TO-SURFACE PRINTING OF INDICIA

(75) Inventors: Mitchell E. Lutz, Fairhaven, MA (US); Steven A. Bresnahan, Plano, TX (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/829,008

(22) Filed: Mar. 23, 2001

(65) Prior Publication Data

US 2002/0134258 A1 Sep. 26, 2002

(51) Int. Cl.[7] ..... B41F 17/00
(52) U.S. Cl. ..... 101/35; 101/4; 101/DIG. 40
(58) Field of Search ..... 101/35, 4, 32, 101/494, DIG. 40

(56) References Cited

U.S. PATENT DOCUMENTS 5,778,793 A * 7/1998 Mello et al. ..... 101/494
6,013,330 A * 1/2000 Lutz ..... 427/511
6,099,379 A * 8/2000 Eppley ..... 446/392
6,245,386 B1 * 6/2001 Felker et al. ..... 427/558
6,276,266 B1 * 8/2001 Dietz et al. ..... 101/DIG. 40

FOREIGN PATENT DOCUMENTS

JP 08-322967 * 12/1996
WO WO 00-20219 * 4/2000

* cited by examiner

*Primary Examiner*—Andrew H. Hirshfeld
*Assistant Examiner*—Minh H. Chau
(74) *Attorney, Agent, or Firm*—William B. Lacy

(57) ABSTRACT

A method for finishing a golf ball comprising the steps of providing a golf ball having a three-dimensional dimpled surface; preparing the surface for receiving at least one indicia; providing a digital image having at least one color; providing a multi-layered pad-printing substrate having at least one layer; etching the image into the at least one layer of the substrate with a laser; distributing a layer of ink over the etched substrate; providing at least one pad for transferring the ink from the substrate to the three-dimensional surface; and transferring the image from the substrate to the dimpled surface of the golf ball.

26 Claims, 1 Drawing Sheet

METHOD OF FINISHING GOLF BALLS EMPLOYING DIRECT DIGITAL-TO-SURFACE PRINTING OF INDICIA

FIELD OF THE INVENTION

This invention relates to a method of "finishing" a golf ball and, in particular, preparing a golf ball to receive indicia, creating a digital image of the indicia, and directly printing the image on the dimpled surface of the golf ball.

BACKGROUND OF THE INVENTION

More than five hundred million golf balls are produced each year, a significant percentage of which have indicia or logos printed on their outer surface. The indicia typically include any one of the golf ball company, tradename, a number, or an image, such as a corporate or country club logo. The most common method for adding a logo to the dimpled surface of a golf ball is by pad printing, although other methods, such as inkjet printing, are adaptable for such surfaces.

The pad printing process begins by spreading ink across the surface of a pad printing cliché or "plate" containing etched or depressed version of the desired image. Ink is dispersed over the etched area and excess ink is removed with a "doctor" blade or cup. Upon exposure to air, thinner evaporates from the ink causing it's surface to become "tacky." A smooth, resilient, block of silicone rubber (the "pad") is brought into contact with the tacky surface of the ink. As the pad is withdrawn from the plate surface, an adhering film of ink is transferred to the pad. The ink is carried on the pad to the target area on the golf ball surface, during which time thinner in the ink further evaporates, causing the exposed ink surface on the pad to become tacky. Upon contact with the golf ball surface, the film of ink is transferred from the pad to the ball surface.

Pad printing plates are typically stiff plates coated with a photopolymer material that cures upon exposure to UV light. The etched version of the image is formed by placing a film positive of the image over the plate and irradiating the surface with UV light. In this manner, the exposed areas of the plate harden, while blocked areas remain soft. The soft polymer is then removed by a series of washing steps, creating etched areas correlating to the logo.

The pad printing process, however, is not without limitations. Creating the etched plates is a time-consuming process involving many steps. Commercially-available photopolymer plates all require the use of chemicals in many of the steps and a variety of solvents, including alcohols, for the washing steps. Further, the plates must be created within a finite time prior to printing, each spot color in the image or selected color space requires a separate plate, and the depth of etch in each plate can be difficult to control. When a new image is desired, the entire process of creating an etched plate for each color must be repeated. Finally, the clean up of plate materials, chemicals, inks, and printing machines, can be exhaustive, and requires strict compliance with a variety of environmental regulations.

It would be desirable, therefore, to develop a method for "finishing" a golf ball and simply and efficiently creating printed indicia on the ball directly from a digital image. Further, it would be desirable to couple this method with pad printing or inkjet printing for parallel, digital "computer-to-press" printing of indicia concurrently with the finishing of a golf ball.

SUMMARY OF THE INVENTION

The present invention is directed to a method for finishing a golf ball comprising the steps of providing a golf ball having a three-dimensional dimpled surface; preparing the surface for receiving at least one indicia; providing a digital image having at least one color; providing a multi-layered pad-printing substrate having at least one layer; etching the image into the at least one layer of the substrate with a laser; distributing a layer of ink over the etched substrate; providing at least one pad for transferring the ink from the substrate to the three-dimensional surface; and transferring the image from the substrate to the dimpled surface of the golf ball.

The step of preparing the surface for receiving at least one indicia further typically includes buffing, sand blasting, and/or plasma treating the dimpled surface of the golf ball. If desired, the golf ball may be primed and/or top coated subsequent to printing the indicia. Generally, the digital image will include a plurality of colors. If so, the colors are then separated into the individual colors of a predetermined color space. Each individual color of the predetermined color space, therefore, should has an associated pad printing substrate.

The color space is selected from the group consisting of CMYK color space, CMYKOG color space, 4-color color space, 6-color color space, 8-color color space, 12-color color space, or a mixture thereof. It is preferred that the color space is CMYK.

The at least one pad printing substrate preferably includes a flexible, photopolymeric material and, more preferably, includes at least two layers. The first layer is preferably a flexible opaque layer and a second layer is preferably a flexible base layer. The first opaque layer has a thickness of less than about 5 $\mu$m, preferably, from about 5 $\mu$m to about 40 $\mu$m, and more preferably, from about 15 $\mu$m to about 25 $\mu$m.

The second flexible base layer includes at least one of polyester, polyethylene, or a mixture thereof. The laser includes a continuous wave laser, a pulsed laser, a solid state laser, a gas laser, or an excimer laser or, if multiple lasers are used, any combination thereof. The laser emits at a preselected wavelength and, preferably, the at least one laser is a pulsed laser. The pulsed laser should have a power greater than about 20 mW/pulse to sufficiently etch the flexible substrate. If desired, the color separation(s), if more than one are present, may be etched using at least two lasers.

The etched image preferably has a depth of less than about 0.0016 inches, more preferably, from about 0.0004 inches to about 0.0016 inches, and most preferably, from about 0.0006 inches to about 0.0010 inches. The thickness of the ink layer on the golf ball is from about 4 $\mu$m to about 50 $\mu$m, preferably, from about 4 $\mu$m to about 20 $\mu$m. Ideally, the ink on the three-dimensional surface requires no more than about 30 seconds to cure.

The present invention is also directed to a method for finishing a golf ball comprising the steps of providing a golf ball having a three-dimensional dimpled surface; preparing the surface for receiving at least one indicia; providing a digital image having at least one color; transferring the image to the surface with an inkjet head; and treating the surface with a coating comprising a clear coat, a top coat, a primer, or a mixture thereof. Additionally, the step of preparing the surface for receiving at least one indicia further should include at least one of buffing, sand blasting, or plasma treating the dimpled surface. The digital image includes a plurality of colors which, if necessary, are separated into the individual colors of a predetermined color space. If so, the color space can be a CMYK color space, CMYKOG color space, 4-color color space, 6-color color space, 8-color color space, 12-color color space, or a mixture thereof. Preferably, the color space is CMYK. The ink on the three-dimensional surface should cure in no more than about 30 seconds.

DETAILED DESCRIPTION OF THE INVENTION

Figure 1:
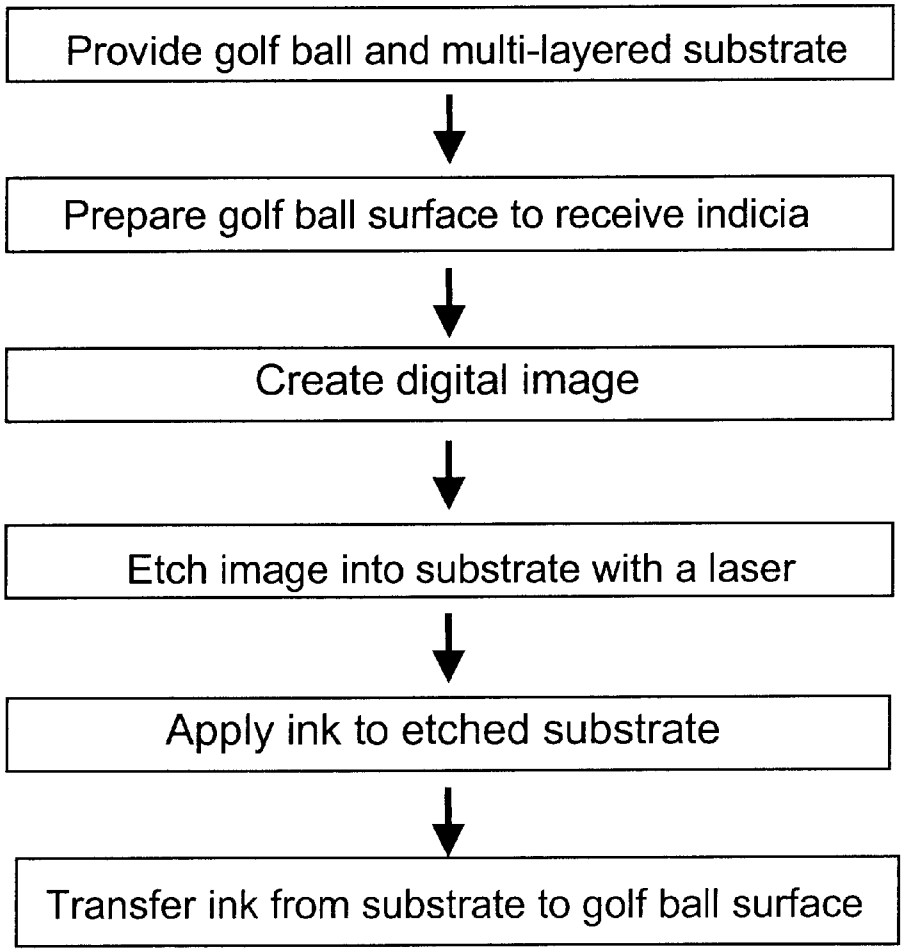
FIG. 1 is a flow chart of the printing process described by the present inventor.

The present invention is directed to a method for finishing a golf ball and, in particular, preparing the golf ball for receiving printed indicia, such as logos or patterns, directly from a digital image to the surface of the ball. Preferably, the surface of the golf ball is prepared for receiving the indicia by buffing, sand blasting, or plasma treating. Generally, the step of preparing the surface and printing are followed by at least one of a clear coat and top coat, however, it should be understood that the present invention is not limited to any particular order of preparing, printing, and coating. For example, the golf ball may be prepared, coated, and printed or the clear coat and top coat may be combined into a single step, either prior to or after the printing step.

The indicia, which appear on rounded or curved three-dimensional surfaces, in particular, golf balls, generally incorporate at least one spot color or a plurality of different colors and/or a shading effect (e.g., a gradient) in all or part of the design. The indicia may be printed in any manner known to one of ordinary skill in the art, such as pad printing or ink-jet printing.

As used herein, the terms "pattern," "image," "indicia," or "logo" are the same for purposes of this invention and are considered to mean any symbol, letter, group of letters, design, image, or the like, that can be added to the dimpled surface of a golf ball.

In a preferred embodiment of the present invention, the image is pad-printed onto the golf ball surface. Preferably, a flexible photopolymer substrate is etched with the image (or portion of the image) by laser irradiation. The etched image may be the entire image if the image is a single spot color, or it the etching may correspond to a specific part of an image that is dedicated to one particular color of a multi-colored image. For example, if the image can be divided into the combination of a number of discrete colors of a color space, such as a CMYK color space, then each portion of the image corresponding to that particular color can be etched on to separate substrates.

A digital copy of the logo or pattern to be printed on the golf ball can be created by any one of a variety of well-known methods. For example, the image may be created or scanned as a graphic image in one of many colorspace formats, such as the "RGB" (a 3-color system comprising the colors red, green, and blue) or "CMYK" (a 4-color system comprising the colors cyan, magenta, yellow, and black) colorspace. The RGB color space includes colors that can be defined as 0 to 100% red, 0 to 100% green, and 0 to 100% blue, whereas the CMYK color space incorporates colors which can be defined as 0 to 100% cyan, 0 to 100% magenta, 0 to 100% yellow, and 0 to 100% black. By adding orange and green to the CMYK color space, a six-color system can be obtained allowing for an even greater color range to be obtained. The digital image is either created or imported into image manipulation software that allows the designer to view the specific color channels, or separations of the selected color system (e.g., CMYK), prior to printing. Preferably, the images to be printed comprise at least two spot colors and, more preferably, the images comprise a plurality of colors and effects requiring a colorspace selection. This is especially true for images that require complex overlapping of colors to form colors different from the four primary colors of the CMYK process, for example.

Once the image has been manipulated (e.g., clarity, contrast, color adjustment) and is in an acceptable graphical format (e.g., .eps, .tif, .jpg, etc.), the image can be ready for etching onto the pad printing substrate. The etching process is preferably accomplished by directly etching the digital image (whole or part) into the pad printing substrate material by laser irradiation. Any substrate material capable of withstanding laser irradiation creation of an etched image is suitable. Preferably, however, the photopolymer substrate material is a flexible roll of material.

The pad printing substrate material typically comprises a photopolymer formed of at least two sections: an opaque top layer adhered to a flexible base layer substrate. The opaque top layer may be constructed of many materials but it is preferred that opaque top layer comprises a photosensitive polymer that absorbs light energy at a variety of predetermined wavelengths of laser radiation. Suitable photosensitive polymers for the opaque top layer include polyester and pigmented polyester. If a polymer is impregnated with a pigment, it is understood that the pigment absorbs in the range of wavelengths emitted by the predetermined laser.

The opaque top layer should absorb laser radiation at a variety of wavelengths, including UV, visible, near-IR, and IR. If a pulsed laser (i.e., Nd:YAG laser) is used, preferably, the opaque top layer of the present invention absorbs in the near-IR range, typically from about 900 nm to 1100 nm. Most preferably, the opaque top layer absorbs at a wavelength of about 1064 nm, such as the fundamental emission line from a Nd:YAG laser. If a continuous wave laser is used (i.e., argon-ion or krypton-ion laser), preferably the emission wavelength is between about 300 nm and about 800 nm, and, more preferably, between about 350 nm and about 550 nm.

At least one laser is present to etch the image into the photopolymer plate material. If more than one laser are operating, preferably they operate at substantially the same wavelength, but may operate at different wavelengths. A variety of lasers are suitable for etching the image into the opaque top layer, such as continuous wave ("CW") laser, pulsed lasers, dye lasers, and excimer lasers. Preferably, the laser is a pulsed laser, such as a Nd:YAG laser operating at 1064 nm. It should be understood that the present invention is not intended to be limited only to the laser lines mentioned herein, as almost every type of laser can generate laser lines at a variety of distinct wavelengths that are suitable for use according to the present invention. The laser should have sufficient power to etch the opaque top layer to the predetermined depth for ideal pad printing. Preferably, the laser power is greater than about 20 mW/pulse for a pulsed laser (i.e., an excimer laser) or greater than about 50 mW for a CW laser (i.e., an $Ar^{2+}$ or $Kr^{2+}$ laser) operating in the visible wavelengths, although one of ordinary skill in the art would be aware that power density changes with spot size of the laser beam and that this can be controlled with much precision by the operator.

The flexible base layer substrate may be constructed of many polymeric materials, such as MYLAR®, polyester, and polyethylene. The thickness of the flexible base layer should be sufficient to withstand positioning and stabilization means encountered throughout the printing process. Preferably, the flexible base layer has a thickness of greater than about 0.5 mm and, more preferably, greater than about 2 mm.

The thickness of the opaque top layer determines the depth of the etch. The thickness of the opaque top layer is typically less than about 40 μm. Preferably, the thickness of the opaque top layer is from about 10 μm to about 40 μm and, more preferably, from about 15 μm to about 25 μm. Preferably, the depth of etch should be less than about 0.0016 inches. More preferably, the depth of etch should be from about 0.0004 inches to 0.0016 inches. Most preferably, the depth of etch should be from about 0.0006 inches to 0.0010 inches. An adhesive layer may be optionally included to help join the opaque top layer to the flexible base layer.

The pad printing substrate may be exposed to laser irradiation for any period sufficient to properly etch the image into the surface of the opaque top layer. Preferably, the exposure period is less than about 30 sec and, more preferably, for a period of from about 5 sec to about 30 sec.

The combination of the at least one opaque top layer and the at least one flexible base layer are preferably provided in the form of a roll. Suitable rolls typically include enough material such that at least 100 images and, preferably, 500 images can be printed from a single roll. Preferably, the roll is at least about 25 m in length and, more preferably, the roll is at least about 50 m in length.

Any type of ink may be used in the printing process of the present invention. There are numerous types of inks available within the printing industry, such as solvent evaporating inks, oxidation curing inks, reactive (catalyst curing or two-component) inks, baking inks, UV curable inks, sublimation inks, and ceramic and glass inks.

Solvent-based inks are predominant in the pad printing industry, as they dry very rapidly through solvent evaporation alone. They are very versatile inks, as they are available in both gloss and matte finishes and perform very well with many thermoplastic substrates. Oxidative curing inks have limited uses in pad printing applications due to their slow drying speed. They do, however, produce very tough, flexible, weather-resistant ink films and are very useful for printing onto metal and glass surfaces.

It is possible to use one-component inks according to the invention, and in one embodiment this is preferred because their long shelf-life can make them easier to work with and more economical. Some one-component inks are highly resistant to abrasion and solvents. Curing can take place physically or by oxidation.

Two-component inks can also be used extensively in pad printing according to the invention and contain resins capable of polymerization. These inks cure very rapidly, especially when heated and are generally good for printing on substrates such as metals, some plastics, and glass, and have very good chemical and abrasion resistance. The inks, though, do have a restricted shelf-life once a polymerization catalyst has been added. With two-component inks, curing typically takes place over about a 5-day period at a temperature of at least about 20° C., or over about a 10 min. period at a temperature of at least about 100° C.

Ceramic and gas thermoplastic inks are also used in pad printing according to the present invention. These inks are solid at room temperature and must be heated in the ink reservoir to a temperature greater than about 80° C. Unlike solvent evaporating inks, pad wetting occurs due to the cooling effect the pad has on the heated ink rather than because of the evaporation of solvent. Ink transfer occurs because the outer surface of the ink becomes tacky when exposed to air. The ink transfer is aided by the cooler surface of the substrate to be printed on.

Ultraviolet ("UV") ink can also be used in the present invention. UV inks are typically cured by means of UV light having wavelengths of from about 180 nm to about 380 nm. The advantages of using a UV ink are that they are fast and cure thoroughly, they are easy to use and are not affected by small changes in ambient conditions, they retain constant viscosity (i.e., they do not dry up quickly), and they use smaller amounts of combustible organic solvent such that little or no solvent fumes escape into the working environment and are, therefore, environmentally safer. Small amounts of solvent may be added to the UV inks for certain applications to enable the ink to transfer in a conventional manner.

The inks may optionally contain additives such as binders, reactive prepolymers, thinners, low-viscosity mono and poly-functional monomers, photoinitiators to stimulate polymerization, stabilizing additives, flow control agents, wetting agents, pigments, extenders, or combinations thereof.

The thickness of the ink film transferred to a golf ball can be any thickness that is sufficient to provide a clear image of the logo. This thickness can be from about 4 to 50 μm, preferably from about 4 to 20 μm. The thickness of the ink film can vary with the ink type and color, and is also influenced by the ink's viscosity, the pad material, the depth of etching in the plate and also environmental factors such as temperature, humidity, and so on.

After the printing process is complete, the golf balls should typically be removed to a dry room to cure the ink used for the image imprint. The dry room can be maintained at an elevated temperature to aid in drying the image ink. For example, the dry room can typically be kept at 40° C. and the balls then kept in the dry room for approximately four hours.

The term "about," as used herein in connection with one or more numbers or numerical ranges, should be understood to refer to all such numbers, including all numbers in a range.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those of ordinary skill in the art from the foregoing description. Such modifications are also intended to fall within the scope of the appended claims.

What is claimed is:

1. A method for finishing a golf ball comprising the steps of:

a) providing a golf ball having a three-dimensional dimpled surface;

b) preparing the surface for receiving at least one indicia;

c) providing a digital image having at least one color;

d) providing a multi-layered pad-printing substrate having at least one layer;

e) etching the image into the at least one layer of the substrate with a laser;

f) distributing a layer of ink over the etched substrate;

g) providing at least one pad for transferring the ink from the substrate to the three-dimensional surface; and h) transferring the image from the substrate to the dimpled surface of the golf ball.

2. The method of claim 1, wherein the step of preparing the surface for receiving at least one indicia further comprises at least one of buffing, sand blasting, or plasma treating the dimpled surface.

3. The method of claim 1, further comprising the steps of:

providing a primer layer; and providing a topcoat layer.

4. The method of claim 1, wherein the digital image comprises a plurality of colors.

5. The method of claim 4, wherein the plurality of colors are separated into the individual colors of a predetermined color space.

6. The method of claim 5, wherein each individual color of the predetermined color space has an associated pad printing substrate.

7. The method of claim 5, wherein the color space is selected from the group consisting of CMYK color space, CMYKOG color space, 4-color color space, 6-color color space, 8-color color space, 12-color color space, or a mixture thereof.

8. The method of claim 7, wherein the color space is CMYK.

9. The method of claim 1, wherein the at least one pad printing substrate comprises a flexible, photopolymeric material.

10. The method of claim 9, wherein the at least one pad printing substrate comprises at least two layers.

11. The method of claim 9, wherein the at least one substrate comprises a first flexible opaque layer and asecond flexible base layer.

12. The method of claim 11, wherein the first opaque layer has a thickness of less than about 40 $\mu$m.

13. The method of claim 12, wherein the first opaque layer has a thickness from about 5 $\mu$m edit to about 40 $\mu$m.

14. The method of claim 13, wherein the first opaque layer has a thickness from about 15 $\mu$m to about 25 $\mu$m.

15. The method of claim 11, wherein thesecond flexible base layer comprises at least one of polyester, polyethylene, or mixtures thereof.

16. The method of claim 1, wherein the laser comprises a continuous wave laser, a pulsed laser, a solid state laser, a gas laser, or an excimer laser.

17. The method of claim 16, wherein the laser emits at a preselected wavelength.

18. The method of claim 16, wherein the at least one laser is a pulsed laser.

19. The method of claim 18, wherein the at least one laser has a power greater than about 20 mW/pulse.

20. The method of claim 1, wherein the color separation (s) are etched using at least two lasers.

21. The method of claim 1, wherein the etched image has a depth of less than about 0.0016 inches.

22. The method of claim 21, wherein the etched image has a depth from about 0.0004 inches to about 0.0016 inches.

23. The method of claim 22, wherein the etched image has a depth from about 0.0006 inches to about 0.0010 inches.

24. The method of claim 1, wherein the thickness of the ink layer is from about 4 $\mu$m to about 50 $\mu$m.

25. The method of claim 24, wherein the thickness of the ink layer is from about 4 $\mu$m to about 20 $\mu$m.

26. The method of claim 1, wherein the ink on the three-dimensional surface requires no more than about 30 seconds to cure.

* * * * *